United States Patent [19]

Shapiro

[11] Patent Number: 4,654,022

[45] Date of Patent: Mar. 31, 1987

[54] RINSING ON A SOLID BOWL CENTRIFUGE

[75] Inventor: Leonard Shapiro, Doylestown, Pa.

[73] Assignee: Pennwalt Corporation, Philadelphia, Pa.

[21] Appl. No.: 824,480

[22] Filed: Jan. 31, 1986

[51] Int. Cl.[4] ..... B04B 15/12

[52] U.S. Cl. ..... 494/29; 494/54

[58] Field of Search ..... 494/53, 54, 27, 29, 494/55, 52, 37, 85, 50; 210/772, 359

[56] References Cited

U.S. PATENT DOCUMENTS

| | | | |
|---|---|---|---|
| 3,228,594 | 1/1966 | Amero | 494/53 |
| 3,802,621 | 4/1974 | Merzenich | 494/29 |
| 3,960,318 | 6/1976 | Dahlberg | 494/27 |
| 3,967,778 | 7/1976 | Hunwick | 494/29 |
| 4,496,340 | 1/1985 | Redeker | 494/53 |

*Primary Examiner*—Robert W. Jenkins

[57] ABSTRACT

Screw conveyor of solid bowl centrifuge has its flight member modified at the bowl dry beach area by welding sheet metal, for example, to trailing surfaces of the flight forming a chamber for rinse liquid driven thereinto. Leading or working surfaces of the flight are provided with a plurality of series of orifices per 360° revolution thereof, each series comprising spaced orifices extending inwardly from a distal portion thereof and preferentially angled therethrough. Overflow passageways with cooperating baffles are provided. Thus, rinse liquid passes onto solids pile surfaces through orifices immediately inwardly thereof as well as through orifices submerged by the solids for passage of rinse liquid thereinto.

24 Claims, 6 Drawing Figures

RINSING ON A SOLID BOWL CENTRIFUGE

STATEMENT OF THE INVENTION

This invention relates to centrifuges and more particularly to improved solid bowl decanter centrifuge structure which produces a desired level of purity of the separated solids by a rinsing thereof with a minimum amount of wash fluid.

BACKGROUND AND SUMMARY OF THE INVENTION

A problem which persists in the rinsing of mother liquor from separated solids in a decanter centrifuge is to apply a minimum quantity of rinse liquid or wash fluid directly to the solids cake in the dry beach area as far outwardly as possible to insure that the rinse liquid is spread to the solids and not short-circuited around the flight. Most existing rinsing systems direct the rinse liquid onto the free surfaces of the separated solids pile, or the rise liquid is sprayed by nozzles onto the solids pile. Neither method is efficient since the rinse liquid merely contacts the surfaces of the solids pile without permeating and contacting the interior thereof. Also, the exact location and shape of the solids pile is unknown and therefore difficult to direct the rinse liquid thereonto. The discharged solids thus usually contain undesirably high quantities of the mother liquor or an excessive amount of rinse liquid is needed to achieve desired purity.

Minimum rinse flow is desirable since the cost of providing rinse fluid is high; power demand increases with higher rinse rates and the final product should be as dry as possible. Space for dewatering the rinse liquid from the solids on the dry beach is finite.

The present invention discloses a rinsing scheme wherein spaced orifices, extending radially or spirally inwardly from distal portions of the flight along the working surfaces thereof, pass the rinse liquid therethrough after passing through holes provided in the conveyor hub for collection in a chamber formed continuously along the rear or non-working surfaces of the flight.

Depending upon factors to be discussed hereinafter, the rinse liquid is caused to flow directly onto the solids pile which is continuously forming through orifices immediately inwardly the solids pile surfaces and also into the solids pile from more distally disposed orifices submerged by the solids. As the solids cake continues to grow, rinse liquid passes through those orifices now immediately inwardly thereof, insuring separated solids to be discharged with a desired degree of purity.

It should be noted that orifices above the solids (inwardly thereof) also allow rinse liquid to slide down the face of the flight and onto the wedge of solids, further enhancing the purity of the separated solids. Such arrangement precludes the possibility of rinse liquid passing through air or space occasioned possibly by a left hand helix causing the flight to move away from the rinse liquid.

DETAILED DESCRIPTION OF THE INVENTION

Figure 1:
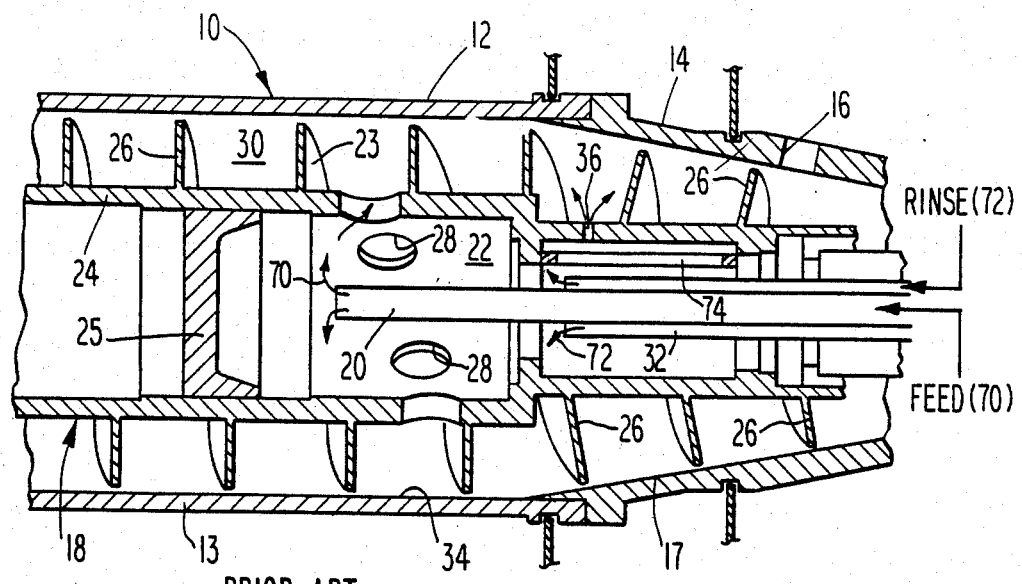
PRIOR ART Fig. 1
FIG. 1 is a fragmentary, longitudinal sectioned view of a prior art solid bowl centrifuge taken through the rotational axis thereof.

Referring to FIG. 1, centrifuge apparatus 10 comprises an axially elongated bowl 12 of annular cross-section which receives the solids-liquid mixture. Bowl 12 is adapted for rotation about a longitudinal axis. In addition to a main portion 13 of generally cylindrical shape, bowl 12 includes a tapered or convergent end portion 14 of generally trunco-conical form. The inner surface 34 of end portion 14 of bowl 12 gradually decreases in diameter towards solids discharge ports 16, the inner surface 34 of the bowl thus providing a drying "beach" 17 for solids moving toward port 16 and out of the liquid pool, or pond, (not shown) created by the centrifugal action when apparatus 10 is in use.

Coaxially mounted within bowl 12 is a helical screw conveyor 18, consisting of a hub 24 on which is mounted a flight 26, helically formed, and having a plurality of turns or revolutions. Conveyor 18 is rotatably mounted on a common axis with bowl 12 and is adapted to be driven at a speed slightly different from that of bowl 12, as a result of which the solds are conveyed in axial direction toward the solid discharge ports 16 by contact with the leading (working) surface of flight 26.

The solids-liquid mixture 70 is delivered as feed to the interior of centrifuge 10 through a stationary feed tube 20. Tube 20 projects in an axial direction and terminates concentrically of a feed chamber 22 defined by the interior of hub 24 and target 25. Feed introduced into feed chamber 22 exits radially therefrom through feed passage 28 into separation chamber 30 disposed between the outer surface of hub 24 and the inner surface of bowl 12. Effluent is discharged through liquid discharge openings (not shown).

Coaxially mounted around feed tube 20 is rinse liquid feed tube 32 for introducing a suitable rinse liquid therein. Rinse liquid and slurry feed are simultaneously introduced into their respective feed tubes by means not shown. The rinse liquid 72 is collected in a conventional rotating collector 74 which drives the rinse liquid through holes 36 provided in hub 24 into separation chamber 30 at dry beach area 17. By means of nozzles (not shown), for example, disposed in holes 36, the rinse liquid is sprayed onto the area where the solid pile is thought to be or against the flight, where it subsequently contacts the solids surfaces. As aforementioned, such methods provide discharged solids of less than desired purity at reasonable rinse rates.

Figure 2:
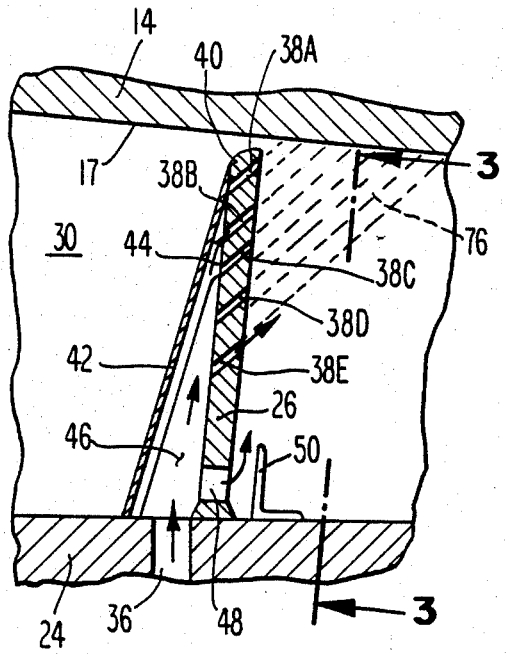
FIG. 2 is a view of a portion of the centrifuge of FIG. 1, partially sectioned, and modified in accordance with an embodiment of the present invention.
Figure 3:
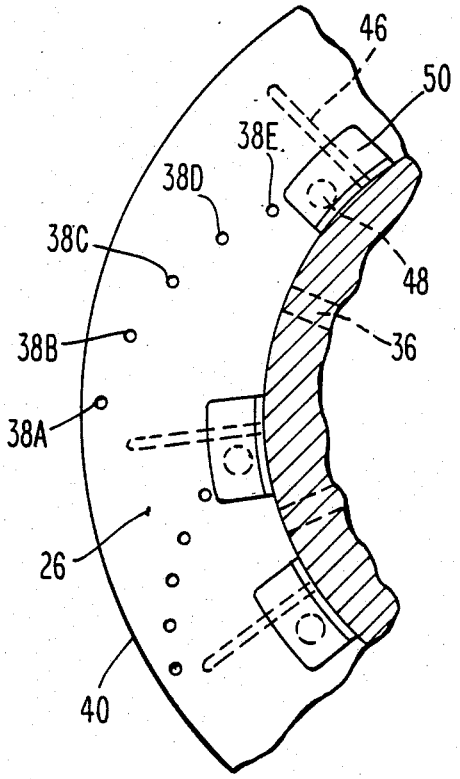
FIG. 3 is a view, partially in section, of the centrifuge of FIG. 2 looking in the direction of arrows 3—3.

In FIGS. 2 and 3, flight 26 at dry beach 17 is provided with a plurality of spaced orifices 38, designated 38A through 38E disposed radially or spirally inwardly from a distal portion 40 of the flight. Orifices 38, typically 0.030 to 0.125 inches in diameter, are drilled in the leading or working surface of the flight at an angle of about 45°, as shown in FIG. 2 to insure self-draining of the orifices. The orifices are also drilled askew through the flight which, in cooperation with the 45° disposition of the orifices, discourage the solids material from being scooped into the orifices resulting in possible plugging thereof when conveyor 18 and bowl 12 are rotating at their prescribed different speeds of rotation. Skewing of the orifices causes the solids to slide tangentially thereacross during operation. Of course, more or less than 5 orifices per sector and 4 or more sectors per turn may be employed.

At least one 360° revolution of the flight, up to two or three revolutions thereof, are provided with a continuous sheet of sheet metal 42 at their rear faces forming spiral chamber 44 for collecting the rinse liquid flowing thereinto from holes 36. Prior to welding sheet metal 42 into place, ribs 46 are welded to the rear face of the flight for preventing the rinse liquid from spiraling around the rotating flight due to coriolis forces caused by rotation of the conveyor and insuring uniform flow for each sector of the flight. Overflow passageways 48 are provided at inner portions of the flight, inwardly of orifices 38. Baffles 50 are secured to hub 24 adjacent passageways 48 and forwardly thereof.

It is understood that the above description is also applicable to multiple lead conveyor flights.

In operation, assume a small wedge of solids 76 forms against flight 26 adjacent distal portions 40. The wedge is not sufficiently deep however to block orifices 38A. Hydraulic centrifugal force urges rinse fluid through orifices 38A onto the solids pile. As the level of solids 76 (FIGS. 2 and 4) builds up such that orifices 38A become submerged, the next set of inwardly disposed orifices (38B) will pass a portion of the rinse liquid therethrough onto the solids pile. The remaining portion of the rinse liquid passes through orifices 38A into the solids pile, the amount depending upon the pressure of the rinse liquid at the entrance of orifices 38A, diameter of the orifices, and the nature of the solids obstructing egress of the rinse liquid from the orifices, i.e., the permeability of the solids pile to the particular rinse liquid selected. The rinse liquid passing through orifices 38A into the solids pile percolate outwardly to further purify the solids prior to being conveyed to liquid discharge ports at the other end of the centrifuge bowl.

As the solids level continues to build, rinse liquid will be urged out those orifices immediately inwardly the solids pile surfaces, and partially through submerged orifices into the pile. Since the density of the solids pile becomes progessively greater as the dry beach wall 17 is approached, the amount of rinse liquid urged out of submerged orifices is proportionately decreased as the orifices are disposed more outwardly in the flight.

When the pressure drop of the rinse liquid through the series of orifices becomes sufficiently high, the rinse liquid will rise within chamber 44 to commence flowing out overflow passageways 48, drilled with a diameter larger than those of the orifices. Liquid forced out of overflow passageways 48 impact baffles 50 which direct the liquid onto the flight working surfaces for flowing onto the solids pile.

The orifices may be tapered, i.e., the exit portion of the orifices is of lesser diameter than the portion thereof which communicates with chambers 44 to prevent solid material from becoming wedged in the orifices.

Ribs 46, overflow passageways 48, baffles 50, and holes 36, are employed in equal numbers in the present invention.

Figure 4:
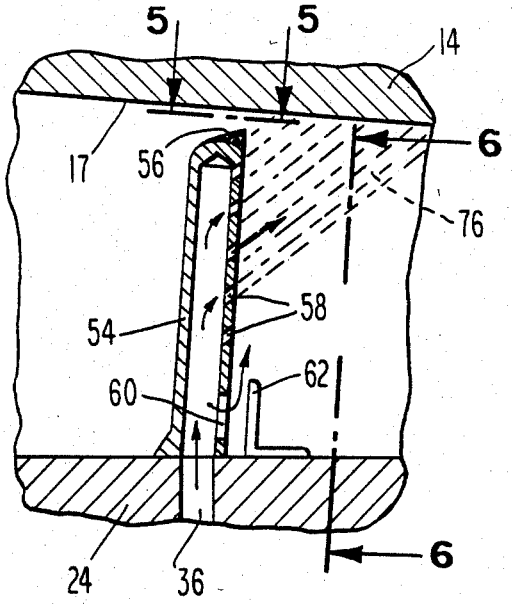
FIG. 4 is a view similar to FIG. 2 illustrating another embodiment of the present invention.
Figure 6:
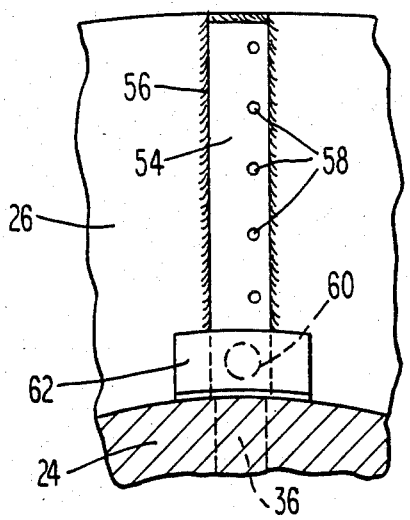
FIG. 6 is a fragmentary view, partially sectioned, of the modified embodiment illustrated in FIG. 4 looking in the direction of arrows 6—6.
Figure 5:
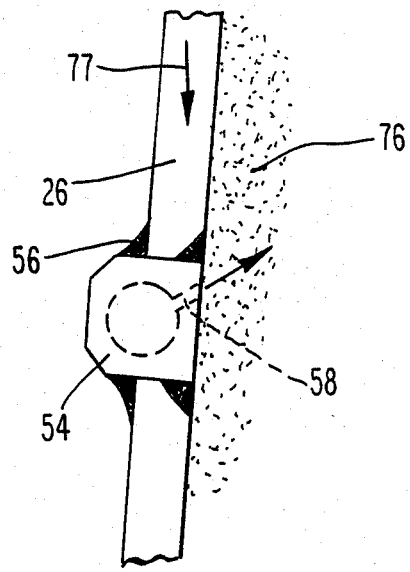
FIG. 5 is a fragmentary view of the modified embodiment illustrated in FIG. 4 looking in the direction of arrows 5—5.

In the modified embodiment of FIGS. 4, 5 and 6, an existing conveyor flight is radially notched to accommodate tubes 54 welded thereto at 56, for example. Typically, the flight will contain 8 to 16 notched cutouts per 360° of flight revolution.

Tubes 54 are provided with pre-drilled orifices 58 and overflow passageways 60. Baffles 62 are attached to the hub forwardly the passageways. Holes 36 are aligned substantially with the axes of tubes 54. Orifices 58 are disposed at an angle of about 45° through tubes 54 and are skewed therethrough as abovediscussed. Orifices 58, overflow passageways 60 and baffles 62 serve the same purposes as do orifices 38, overflow passageways 48 and baffles 50 described with reference to FIGS. 2 and 3 of the drawings.

The embodiment illustrated in FIGS. 4, 5 and 6 requires no ribs 46 as does the continuous spiral chambers 44 of FIG. 2. The relative velocity of conveyor flight 26 (FIG. 5) with respect to solids 76 on beach 17 is shown by arrow 77.

The front or leading surfaces of tubes 54 may be made flush with the existing flight surface by a simple grinding operation.

Quantitative improvement in the purity of the discharged solids with respect to the amount of rinse liquid needed to achieve the improvement indicated that both embodiments of the present invention are highly rinse efficient.

While the centrifuge is coasting during shutdown, rinse liquid should continue to be fed into the rinse liquid feed tube to prevent solids remaining in the bowl from possibly collecting in chambers 44, tubes 54, and the orifices.

I claim:

1. In a solid bowl centrifuge having a screw conveyor with a spiral flight therearound for separating liquids and solids from slurry fed into said centrifuge, said centrifuge having a dry beach area, said flight at said dry beach area including a chamber forming a part thereof and receiving rinse liquid fed thereinto, said flight at said dry beach area having a plurality of orifices provided in working surfaces thereof, said rinse liquid passing from said chamber through at least one of said plurality of orifices and into, under and above separated solids passing up said dry beach area.

2. In a solid bowl centrifuge having a screw conveyor with a spriral flight therearound for separating liquids and solids from slurry fed into an axially mounted feedpipe, said feedpipe having a rinse liquid feedtube mounted coaxially therearound whereby said rinse liquid from said feedtube is driven to a dry beach area of said bowl for purifying solids material thereat being conveyed to solids discharge ports of said conveyor, said flight having working surfaces and trailing surfaces, the improvement to said centrifuge at said dry beach area comprising means secured within said flight for providing a rinse liquid collection chamber, said means permitting said working surfaces of said flight to remain smooth, orifice means provided in said working surfaces of said flight comunicating with said chamber for selectively passing said collected rinse liquid therethrough, rib means positioned within said chamber for dividing equally said rinse liquid driven thereinto, said rinse liquid in said chamber passing through said orifices immediately inwardly outer surfaces and through said orifices submerged by said solids for passage thereinto.

3. Centrifuge of claim 2 wherein at least a portion of said rinse liquid in said chamber passes through said orifices partially submerged by said solids.

4. Centrifuge of claim 2 wherein said orifices are disposed radially spirally inwardly from a distal portion of said flight.

5. Centrifuge of claim 2 wherein said orifices are disposed radially inwardly from a distal portion of said flight.

6. Centrifuge of claim 4 wherein a series of said radially spirally disposed orifices are provided in at least a 360° revolution of said flight, each of said series having orifices in symmetrical disposition with respect to each other.

7. Centrifuge of claim 2 wherein a series of said radially disposed orifices are provided in at least a 360° revolution of said flight, each of said series having orifices in symmetrical disposition with respect to each other.

8. Centrifuge of claim 5 wherein said rinse liquid in said chamber passes through an equal number of orifices in each of said series thereof.

9. Centrifuge of claim 6 wherein said rinse liquid in said chamber passes through an equal number of orifices in each of said series thereof.

10. Centrifuge of claim 8 wherein said rinse liquid in said chamber passes into said solids from outer orifices of each series thereof submerged by said solids and through orifices of each series thereof immediately inwardly surface of said solids onto said solids.

11. Centrifuge of claim 8 wherein said rinse liquid in said chamber passes into said solids from outer orifices of each series thereof submerged by said solids and through orifices of each series thereof immediately inwardly surface of said solids onto said solids.

12. Centrifuge of claim 10 wherein a rinse liquid overflow passageway is provided with each series of orifices inwardly of the orifice most inwardly disposed of each of said series thereof for permitting said rinse liquid in said chamber to pass through said overflow passageways when pressure drop across orifices of each series is sufficiently high.

13. Centrifuge of claim 10 wherein a rinse liquid overflow passageway is provided with each series of orifices inwardly of the orifice most inwardly disposed of each of said series thereof for permitting said rinse liquid in said chamber to pass through said overflow passageways when pressure drop across orifices of each series is sufficiently high.

14. Centrifuge of claim 12 wherein each overflow passageway of each of said series of orifices is provided wtih a baffle member adjacent thereto for directing rinse liquid urged out of said overflow passageways onto working surfaces of said flight for flowing onto surfaces of said solids wedged thereagainst.

15. Centrifuge of claim 12 wherein each overflow passageway of each of said series of orifices is provided with a baffle member adjacent thereto for directing rinse liquid urged out of said overflow passageways onto working surfaces of said flight for flowing onto surfaces of said solids wedged thereagainst.

16. In a solid bowl centrifuge with a screw conveyor having a spiral flight therearound for separating liquids and solids from slurry fed into an axialy mounted feedpipe, said feedpipe having a rinse liquid feedtube mounted coaxially therearound whereby said rinse liquid from said feedtube is driven to a dry beach area of said bowl for purifying solids material thereat being conveyed to solids discharge ports of said conveyor, said flight having working surfaces and trailing surfaces, the improvement to said centrifuge comprising spaced radial notched cutouts provided in said flight at said dry beach area, container means secured to said flight at each of said notched cutouts for providing a rinse liquid collection chamber within said container means said container means presenting a working surface thereof substantially continuous with working surface of said flight, orifice means provided in said working surface of said container means for selectively passing said collected rinse liquid through those orifices immediately inwardly outer surfaces of slides material wedged up against said flight working surfaces and through those orifices disposed outwardly of said solids material and submerged thereby for passage thereinto.

17. Centrifuge of claim 16 wherein said container means is a tube having a closed end disposed adjacent distal portions of said flight working surface.

18. Centrifuge of claim 17 wherein at least a portion said rinse liquid in said chamber passes through said orifices partially submerged by said solids.

19. Centrifuge of claim 17 wherein said orifices are disposed radially inwardly from a distal portion of said flight.

20. Centrifuge of claim 19 wherein a series of said radially disposed orifices are provided in a 360° revolution of said flight, each of said series having orifices in symmetrical disposition with respect to each other.

21. Centrifuge of claim 20 wherein said rinse liquid in said chamber passes through an equal number of orifices in each of said series thereof.

22. Centrifuge of claim 21 wherein said rinse liquid in said chamber passes into said solids from outer orifices of each series thereof submerged by said solids and through orifices of each series thereof immediately inwardly surface of said solids onto said solids.

23. Centrifuge of claim 22 wherein a rinse liquid overflow passageway is provided with each series of orifices inwardly of the orifice most inwardly disposed of each of said series thereof for permitting said rinse liquid in said chamber to pass through said overflow passageways when pressure drop across orifices of each series is sufficiently high.

24. Centrifuge of claim 23 wherein each overflow passageway of each of said series of orifices is provided with a baffle member adjacent thereto for directing rinse liquid urged out of said tube overflow passageways onto working surfaces of said flight in said dry beach area for flowing onto surfaces of said solids wedged against said flight in said dry beach area.

* * * * *

UNITED STATES PATENT AND TRADEMARK OFFICE

CERTIFICATE OF CORRECTION

PATENT NO. : 4,654,022

DATED : March 31, 1987

INVENTOR(S) : Leonard Shapiro

It is certified that error appears in the above—identified patent and that said Letters Patent is hereby corrected as shown below:

Column 5, Line 6: After surfaces, insert: "of solid material wedged up against said flight working surfaces"

Column 6, Line 6: Change "axialy" to axially"

Signed and Sealed this

Twenty-seventh Day of October, 1987

*Attest:*

DONALD J. QUIGG

*Attesting Officer*

*Commissioner of Patents and Trademarks*